US005161946A

United States Patent [19]

Bortz et al.

[11] Patent Number: 5,161,946

[45] Date of Patent: Nov. 10, 1992

[54] SWIRL GENERATOR WITH AXIAL VANES

[75] Inventors: Steven J. Bortz, Laguna Niguel, Calif.; Shyh-Ching Yang, Hsinchu, Taiwan

[73] Assignee: Industrial Technology Research Institute, Hsinchu, Taiwan

[21] Appl. No.: 620,765

[22] Filed: Dec. 3, 1990

[51] Int. Cl.[5] ..... F01D 1/02

[52] U.S. Cl. ..... 415/183; 415/191; 415/208.1

[58] Field of Search ..... 415/182.1, 183, 191, 415/208.1; 431/9, 181, 182, 183, 185; 239/487, 488, 489

[56] References Cited

U.S. PATENT DOCUMENTS 4,479,775 10/1984 Wiesel ..... 431/181
4,695,225 9/1987 Hellat et al. ..... 415/208.1

FOREIGN PATENT DOCUMENTS 710506 8/1931 France ..... 415/208.1
0049609 4/1980 Japan ..... 431/183

*Primary Examiner*—Thomas E. Denion
*Attorney, Agent, or Firm*—Cushman, Darby & Cushman

[57] ABSTRACT

A swirl generator with improved axial vanes having desired shape obtained according to equations. The axial vanes are disposed on a bluff body, are curved, inclined and overlap on one another. When air flow passes through the axial vanes, the desired low pressure drop, and low tubulent intensity swirling flow are provided.

4 Claims, 5 Drawing Sheets

SWIRL GENERATOR WITH AXIAL VANES

BACKGROUND OF THE INVENTION

1. Field of the Invention

The present invention relates to a swirl generator, particularly to a swirl generator with improved axial vanes.

A burner is one of the most important parts in a combustion system. The capability of the burner not only has great influence on the combustion efficiency of the system but also closely relates to the stability of the flame, the effective application of the fuel and the discharge of pollutants.

Improper combustion technology and improper selection of burners not only decreases the effective use of energy, but also results in air pollution by emitting large amount of hazardous combustion products.

2. Description of Related Art

Conventional burners employ a fan or a compressor to send the air into the combustion chamber to mix with the fuel for burning. The blades of the fan of such a conventional burner are of a fixed radial type. In practice, these devices are often operated with low excess-air combustion technics in industrial boilers. Specifically, by means of fuel gas recirculation, the peak temperature of the flame of the burner can be reduced to control thermal-NO. Controlling fuel-rich combustion, reducing peak temperature of flame, controlling residence time of combustion gas and partial fuel-rich combustion and increasing stability of flame are several important keys of advanced burner design. A swirling flow generated by properly-designed swirl generator and fuel-gas recirculator can control the residence time of combustion gas and the flame temperature.

When air flows through the fixed radial flow-guiding vanes to form a swirling flow, if the pressure drop and turbulent intensity are too high, then the capability of the burner will be poor.

Therefore, a good swirl generator must have a low pressure drop, low turbulent intensity and be capable of producing desired recirculation strength and controlling partial fuel-rich combustion, lowering peak temperature, controlling residence time of combustion gas and increasing flame stability.

The swirl generator of this invention can produce swirling flow to change the speed of air flow and deflect the axial incoming flow to produce a divisional angular vector. The swirling air flow then passes through an expansion quarl to form the recirculation flow.

Generally, there are three manners of generating swirling flow field:

1. manner of tangential entry;
2. manner of guided vanes; and
3. manner of rotating pipe.

In this invention, axial vanes are used to produce the required swirling flow field.

When the swirling flow passes through the combustion chamber, bluff body and expansion chamber, the swirling air flow will create reverse pressure gradient to form a recirculation zone. Not only is fuel vigorously mixed with air around this recirculation zone, but also a portion of the hot combustion product gas is recirculated back to sustain proper ignition, thereby assuring flame stability.

The swirling flow has the good quality of increasing flame stability. The proper swirling flow generated by properly-designed swirl generator can control flame, maintain fuel-rich combustion, reduce peak temperature of flame, control residence time of combustion gas, inhibit creation of NOx and increase combustion efficiency.

The axial vanes with fixed rotary angle of this invention are adapted to achieved desired the swirl level under the lowest pressure drop and the lowest turbulent intensity. To accomplish this goal, some extent of overlapping of the axial vanes must exist. Generally, the overlapping is about 30°. However, the range from 20° to 45° is also available so as to insure the complete deflection of the air flow. Moreover, the arch shape of the axial vanes is used to substitute for general plane vanes to produce swirling flow so as to prevent the shortcomings of high pressure drop and high turbulent intensity.

SUMMARY OF THE INVENTION

It is the primary object of this invention to provide a swirl generator with improved axial vanes which can deflect air flow and produce swirling flow by means of arch-shaped axial vanes to prevent high pressure drop, high turbulent intensity and achieve the objects of high flame stability, multiple-fuel swirl burner, complete combustion and low pollution.

It is the further object of this invention to provide the above swirl generator wherein the air will surround the flame reducing the negative affects of the flame on the burner thus reducing the maintenance cost and increasing the useful life of the burner.

DETAILED DESCRIPTION OF THE PREFERRED EMBODIMENT

Figure 1:
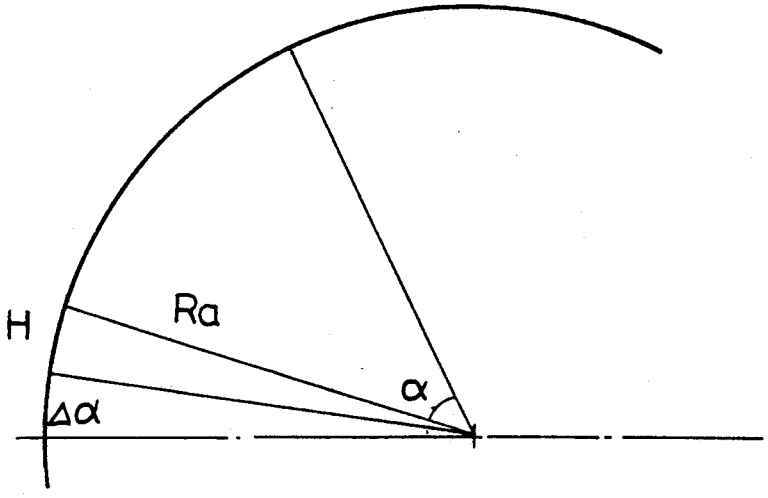
FIG. 1 shows an axial vane divided into portions with length H.
Figure 2:
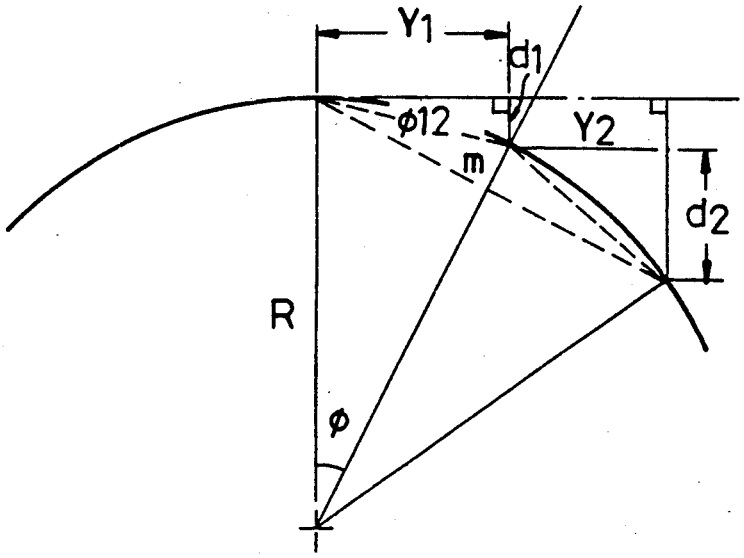
FIG. 2 shows the decreased height d of the divided portions with respect to each increased length H.
Figure 3:
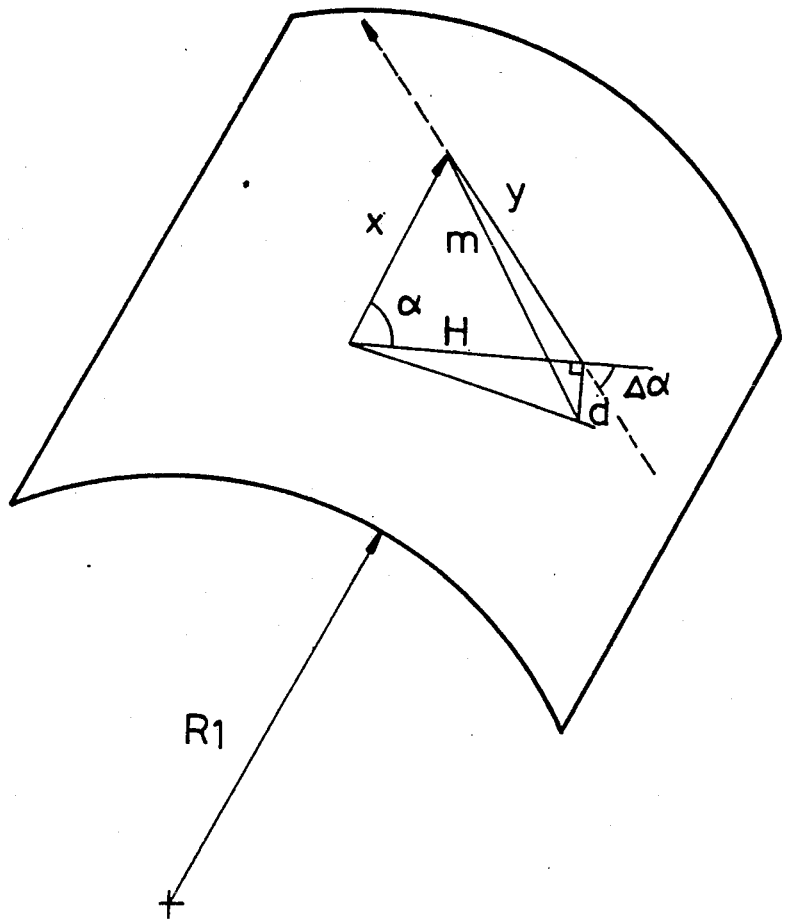
FIG. 3 is a perspective view of a part of the axial vane.

Please first refer to FIGS. 1, 2 and 3, wherein the geometric structure of the axial vanes is shown. The axial vanes with fixed angle have their circular center at the center of the bluff body. The outlet angle of the vane is $\alpha$, the increasing angle is $\Delta\alpha$, and the curvature radius of lower edge of the vane is Ra. The axial vane can be divided into n portions each of which is included so that the vane can be treated to be composed of n plates with length H. Through the geometric analysis, it can be obtained that:

$$H = 2Ra\sin(\Delta\alpha/2) \quad (1)$$

$$\alpha_N = \sum_{n=1}^{N} \Delta\alpha_n \quad (2)$$

For each $\Delta\alpha_N$ and H, according to their geometric relationship, Yn and m can be calculated and the angle $\phi$ along the curve surface can be obtained:

$$Yn = H\mathrm{Sin}\alpha_N \quad (3)$$

-continued $$YN = \sum_{n=1}^{N} Y_n \quad (4)$$

As shown in FIG. 2, the radius (R) is determined from diameter 2R to form a triangle. According to Principle of Circle Periphery Angle, it is acquired that $$\text{Sin}\phi = \frac{m}{2R},$$

i.e., $$\phi = \text{Sin}^{-1}\left(\frac{m}{2R}\right) \quad (5)$$

equating $$\text{Sin}\phi = \frac{m}{2R} \text{ and } \text{Sin}\phi = \frac{d}{m},$$

it is obtained that $m^2=2Rd$

Squaring this equation and introducing the equation $d^2=m^2-YN^2$, it is obtained that $$m = [2R^2 - 2\sqrt{R^4 - Y_N^2 \cdot R^2}]^{\frac{1}{2}} \quad (6)$$

According to the above equation, the decreased height d of the axial vane with respect to the increased length H can be determined by the following equation:

$$d=m.\ \text{Sin}\phi \quad (7)$$

To keep the upper and the lower faces of the axial vane with same angle, the curvature radius Rb of the upper edge of the vane is $$Rb=R2/R1.Ra \quad (8)$$

wherein R1 is the radius of the bluff body, and R2 is the radius of the throat.

Figure 4:
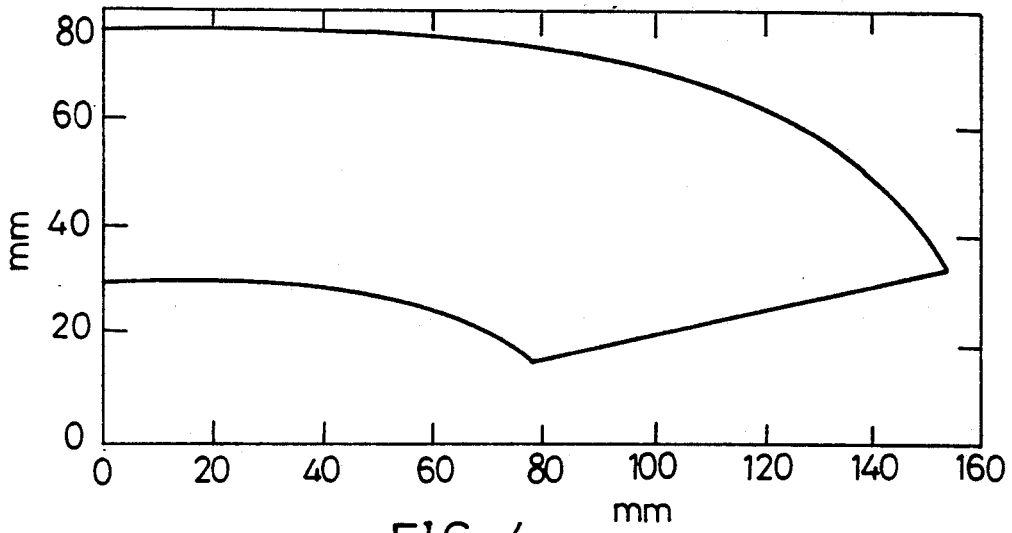
FIG. 4 shows the geometric shape of the axial vane.
Figure 5:
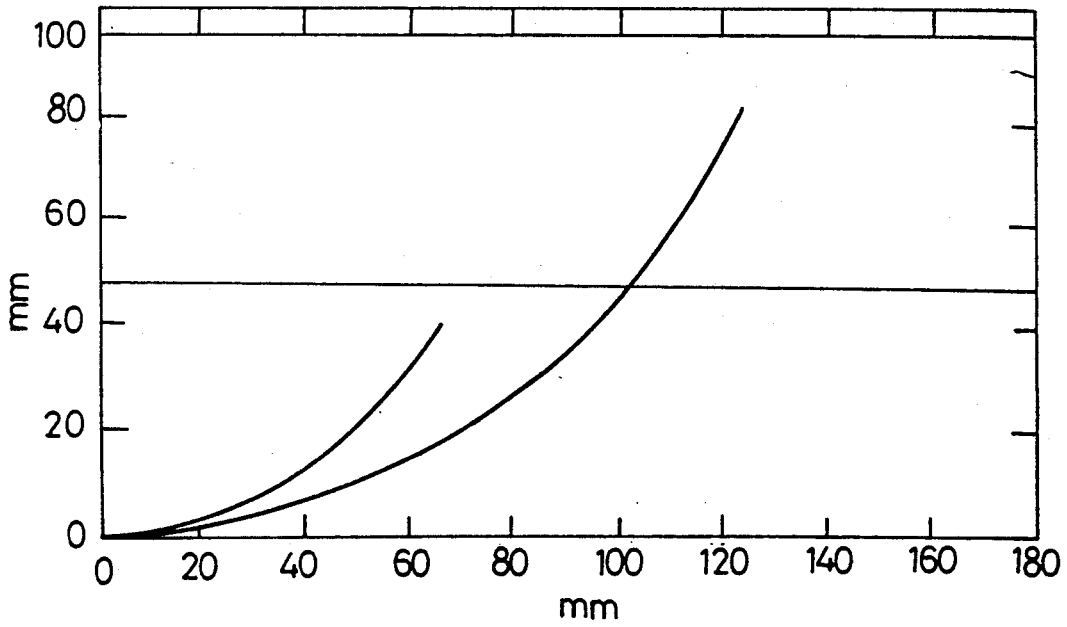
FIG. 5 shows the curvature radius of the upper and the lower edges of the axial vane.

Please refer to FIGS. 4 and 5 wherein the geometric shape and the geometric diagram of the curvature radius of the upper and lower edges of the axial vane are shown. The geometric diagram is established in the following sequence:

(1) determine the radius R1 of the bluff body and the radius R2 of the throat according to the design manners of the fuel, air flow amount, nozzle, etc.;

(2) calculate the outlet angle of the axial vane according to required swirl number;

(3) determine the value of $\Delta\alpha$; generally, the smaller the $\Delta\alpha$ is, the smoother the vane is;

(4) determine the curvature radius Ra of the lower edge of the vane; according to Rb=R2/R1.Ra, the curvature radius R of the outer edge of the vane can be obtained;

(5) calculate respectively according to the following two sets of data:

(Ra, R1, $\alpha$, $\Delta\alpha$) and (Rb, R2, $\alpha$, $\Delta\alpha$);

(6) calculate the values of H and d of each set and determine the coordinate points; and (7) draw the shape of obtained axial vane, wherein $\alpha$: outlet angle of the vane $\Delta\alpha$: increased angle Ra: curvature radius of the lower edge of the vane Rb: curvature radius of the upper edge of the vane R1: radius of the bluff body R2: radius of the throat.

Figure 6:
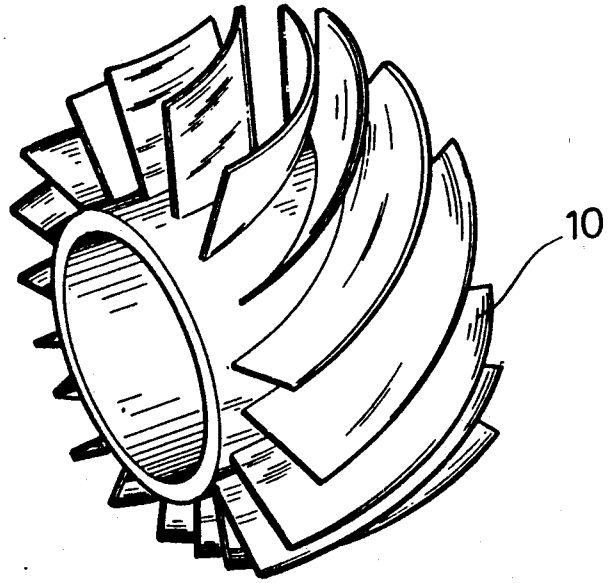
FIG. 6 is a perspective view of the axial vanes of the swirl generator.
Figure 7:
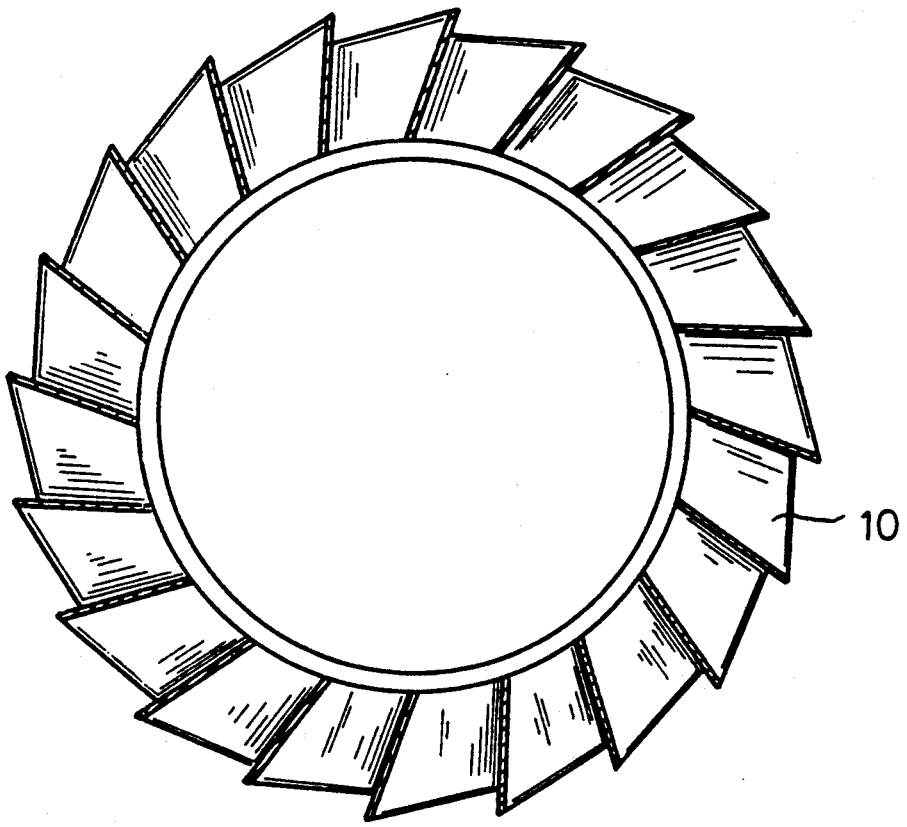
FIG. 7 is a sectional view according to FIG. 6.

Please now refer to FIG. 6 which shows a perspective view of the improved axial vane of this invention. When the air flow passes through the axial vanes 10, swirling flow will be created by the axial vanes 10 with fixed rotary Please now refer to FIG. 7 which shows a sectional view of the improved axial vane, wherein the axial vanes 10 overlaps one another at some extent to insure the complete deflection of the air flow.

An embodiment of this invention as described below shown in FIGS. 4 and 5.

| curvature radius | | lower edge of the vane | upper edge of the vane |
|---|---|---|---|
| R1 | | 75 mm | 150 mm |
| R2 | | 48 mm | 48 mm |
| $\alpha$ | | 59° | 59° |
| $\Delta\alpha$ | | 5° | 5° |
| H(1) = 13.0 | d(1) = 0.003 | H(1) = 25.6 | d(1) = 0.008 |
| H(2) = 6.6 | d(2) = 0.03 | H(2) = 12.8 | d(2) = 0.07 |
| H(3) = 6.6 | d(3) = 0.12 | H(3) = 12.8 | d(3) = 0.29 |
| H(4) = 6.6 | d(4) = 0.33 | H(4) = 12.8 | d(4) = 0.82 |
| H(5) = 6.6 | d(5) = 0.74 | H(5) = 12.8 | d(5) = 1.83 |
| H(6) = 6.6 | d(6) = 1.44 | H(6) = 12.8 | d(6) = 3.6 |
| H(7) = 6.6 | d(7) = 2.54 | H(7) = 12.8 | d(7) = 6.36 |
| H(8) = 6.6 | d(8) = 4.2 | H(8) = 12.8 | d(8) = 10.6 |
| H(9) = 6.6 | d(9) = 6.6 | H(9) = 12.8 | d(9) = 16.9 |
| H(10) = 6.6 | d(10) = 9.9 | H(10) = 12.8 | d(10) = 26.6 |
| H(11) = 6.6 | d(11) = 14.7 | H(11) = 12.8 | d(11) = 43.1 |

According to the above parameters, by means of the following equation, the swirl number of the desired swirling flow can be calculated:

$$S=1.30$$

By means of LDV instrument, the swirl number can be determined and listed as follows:

$$S=G_\phi/Gx.R2 \quad (9)$$

$$\text{where } G_\phi = 2\pi\rho \int_{R_1}^{R_2} uw\gamma^2 d\gamma \text{ (angular momentum)}$$

$$Gx = 2\pi\rho \int_{R_1}^{R_2} u^2\gamma d\gamma \text{ (axial momentum)}$$

U: axial speed

W: tangential speed $\rho$: fluid density

The above $G_\phi$ (angular momentum) will cause centrifugal force to change the distribution of static pressure along the axial and radial directions. The following chart indicates axial speed, axial acceleration, tangential speed, and tangential acceleration for various radii (r)

| No. | r m | U m/s | UU m/s | W m/s | WW m/s |
|---|---|---|---|---|---|
| 1. | .00E + 00 | .00E + 00 | .00E + 00 | .00E + 00 | .00E + 00 |
| 2. | 2.00E − 2 | .00E + 00 | .00E + 00 | .00E + 00 | .00E + 00 |
| 3. | 4.70E − 02 | .00E + 00 | .00E + 00 | .00E + 00 | .00E + 00 |
| 4. | 5.00E − 02 | 4.80E − 02 | 3.67E + 00 | 3.63E + 00 | 4.11E + 00 |
| 5. | 5.00E − 02 | 2.49E + 00 | 4.08E + 00 | 8.36E + 00 | 4.42E + 00 |
| 6. | 5.60E − 02 | 4.00E + 00 | 4.30E + 00 | 1.12E + 01 | 4.51E + 00 |
| 7. | 6.00E − 02 | 6.61E + 00 | 4.38E + 00 | 1.46E + 01 | 4.51E + 00 |
| 8. | 6.40E − 02 | 7.87E − 00 | 4.12E + 00 | 1.75E + 01 | 3.65E + 00 |
| 9. | 6.40E − 02 | 8.625 + 00 | 3.91E + 00 | 2.00E + 01 | 3.26E + 00 |
| 10. | 7.30E − 02 | 9.62E + 00 | 3.61E + 00 | 2.05E + 01 | 3.26E + 00 |
| 11. | 7.60E − 02 | 1.00E + 01 | 3.27E + 00 | 2.01E + 01 | 3.18E + 00 |
| 12. | 7.90E − 02 | 1.04E + 01 | 3.18E + 00 | 1.98E + 01 | 3.18E + 00 |
| 13. | 8.20E − 02 | 1.07E + 01 | 3.01E − 00 | 1.94E + 01 | 3.18E + 00 |
| 14. | 8.60E − 02 | 1.07E + 01 | 2.89 + 00 | 1.89E + 01 | 3.15E + 00 |
| 15. | 9.00E − 02 | 1.10E + 01 | 2.38E + 00 | 1.82E + 01 | 3.14E + 00 |
| 16. | 9.20E − 02 | 1.06E + 01 | 2.79E + 00 | 1.78E + 01 | 3.08E + 00 |
| 17. | 9.40E − 02 | 1.08E + 01 | 2.88E + 00 | 1.74E + 01 | 3.09E + 00 |
| 18. | 9.50E − 02 | 1.07E + 01 | 2.88E + 00 | 1.71E + 01 | 3.00E + 00 |

According to the above description, the present invention provides improved axial vanes of arch shape, which completely deflects the air flow to generate a swirling flow and prevents high pressure drop and high turbulent intensity. As indicated, the structure herein may be variously embodied. Recognizing the various modifications will be apparent, the scope hereof shall be deemed to be defined by the claims as set forth below.

What is claimed is:

1. A swirl generator with axial vanes comprising a plurality of axial vanes disposed upon a bluff body such that the vanes overlap one another so as to deflect an air flow to form a required swirling flow, a shape of the axial vanes is determined by a curvature radius of a lower edge of an axial vane, a curvature radius of an upper edge of the axial vane, a length of the axial vane, and a decreased height of the axial vane by applying the following relationships:

$$H = 2\,R_a \sin(\Delta\alpha/2);$$

$$\alpha_N = \sum_{n=1}^{N} \Delta\,\alpha_n$$

$$Y_n = H \operatorname{Sin} \alpha_n$$

$$Y_N = \sum_{n=1}^{N} Y_n$$

$$d = M \operatorname{Sin} \phi$$

$$\phi = \operatorname{Sin}^{-1}(M/2R)$$

-continued $$M = [2R^2 - 2\sqrt{R^4 - Y_N^2 \cdot R^2}\,]^{\frac{1}{2}}$$

$$R_b = (R_2/R_1) \cdot R_a$$

wherein:

$R_a$ is the curvature radius of a lower edge of said axial vanes;

$R_b$ is the curvature radius of an upper edge of an axial vane;

N is a number of axial vanes on the swirl generator;

$\Delta\alpha$ is an increased outlet angle of an axial vane;

H is the length of an axial vane corresponding to the increased outlet angle;

$\alpha_N$ is a total of all increased outlet angles;

R is a radius of a bluff body to which the axial vanes are attached;

$Y_n$ is an increased length of an axial vane for each corresponding $\Delta\alpha$ and H of the axial vane;

Yn is a total of increased length of n axial vanes;

d is the decreased height of an axial vane;

$\phi$ is a contained angle of an axial vane;

M is a slope of a curved surface of an axial vane; and an upper and lower surface of each said axial vane have the same outlet angle.

2. A swirl generator with axial vanes as claimed in claim 1, wherein the axial vanes overlap by an angle between 20° and 45°.

3. A swirl generator with axial vanes as claimed in claim 2, wherein said axial vanes are of an arch shape.

4. A swirl generator with axial vanes as claimed in claim 1, wherein the axial vanes overlap by an angle of 30°.

* * * * *